US011014368B2

(12) United States Patent
Iinuma et al.

(10) Patent No.: US 11,014,368 B2
(45) Date of Patent: May 25, 2021

(54) INK JET RECORDING APPARATUS AND INK JET RECORDING SET

(71) Applicant: Seiko Epson Corporation, Tokyo (JP)

(72) Inventors: Miki Iinuma, Shiojiri (JP); Tomohito Nakano, Shiojiri (JP); Keisuke Morita, Matsumoto (JP)

(73) Assignee: Seiko Epson Corporation

( * ) Notice: Subject to any disclaimer, the term of this patent is extended or adjusted under 35 U.S.C. 154(b) by 0 days.

(21) Appl. No.: 16/697,264

(22) Filed: Nov. 27, 2019

(65) Prior Publication Data

US 2020/0171833 A1 Jun. 4, 2020

(30) Foreign Application Priority Data

Nov. 29, 2018 (JP) ..... JP2018-223571

(51) Int. Cl.
*B41J 2/175* (2006.01)

(52) U.S. Cl.
CPC ..... *B41J 2/1752* (2013.01); *B41J 2/17503* (2013.01)

(58) Field of Classification Search
CPC ... B41J 2/17503; B41J 2/17506; B41J 2/1752
See application file for complete search history.

(56) References Cited

U.S. PATENT DOCUMENTS

2003/0132980 A1* 7/2003 Yamazaki ..... B41J 2/17509 347/19
2014/0063135 A1* 3/2014 Nakashima ..... B41J 2/175 347/85
2017/0326882 A1* 11/2017 Okude ..... B41J 2/17553
2020/0017701 A1* 1/2020 Jackson ..... C09D 11/033

FOREIGN PATENT DOCUMENTS

JP 63037953 A * 2/1988 ..... B41J 2/175
JP 2015-160923 A 9/2015

* cited by examiner

*Primary Examiner* — Matthew Luu
*Assistant Examiner* — Kendrick X Liu
(74) *Attorney, Agent, or Firm* — Harness, Dickey & Pierce, P.L.C.

(57) ABSTRACT

An ink jet recording apparatus includes a first tank storing a first ink and a second tank storing a second ink different from the first ink. The first tank and the second tank are arranged so as to have overlap when viewed in a vertical direction in an apparatus-using state.

8 Claims, 6 Drawing Sheets

INK JET RECORDING APPARATUS AND INK JET RECORDING SET

The present application is based on, and claims priority from, JP Application Serial Number 2018-223571, filed Nov. 29, 2018, the disclosure of which is hereby incorporated by reference herein in its entirety.

BACKGROUND

1. Technical Field

The present disclosure relates to an ink jet recording apparatus and an ink jet recording set.

2. Related Art

An ink jet recording method is a method in which a record is made in such a manner that ink droplets are discharged from fine nozzles and are applied to a recording medium. This method has a feature that a high-resolution, high-quality image can be recorded with a relatively inexpensive apparatus at high speed.

Recording apparatuses used in the ink jet recording method have been investigated for various techniques for the purpose of making high-quality records. For example, JP-A-2015-160923 proposes that a high-quality image is recorded using a plurality of inks of different colors.

An ink jet recording apparatus used to record a very high-definition, high quality image called photographics by ink jet is provided with a large number of inks of, for example, six or more colors different from each other in some cases. Each of the inks is stored in a corresponding one of containers, which are mounted in the ink jet recording apparatus. Therefore, the increase in number of inks increases the footprint where the ink jet recording apparatus is placed in some cases. Thus, the following apparatus is required: an ink jet recording apparatus capable of suppressing the footprint thereof to a low level even if the number of inks used therein is large.

SUMMARY

According to an aspect of the present disclosure, an ink jet recording apparatus includes a first tank storing a first ink and a second tank storing a second ink different from the first ink. The first tank and the second tank are arranged so as to have overlap when viewed in a vertical direction in an apparatus-using state.

In the ink jet recording apparatus, the first tank and the second tank may be provided with an ink inlet and the ink inlet of the first tank and the ink inlet of the second tank may have no overlap when viewed in the vertical direction in the apparatus-using state.

In the ink jet recording apparatus, the ink inlet may form an airflow path at the time of pouring ink.

The ink jet recording apparatus may further include six or more tanks storing inks different from each other, the first tank may be one of the six or more tanks, and the second tank may be one of the six or more tanks that is other than the first tank.

In the ink jet recording apparatus, the first tank may be placed above the second tank in the vertical direction in the apparatus-using state and the L* value of the first ink may be greater than the L* value of the second ink.

In the ink jet recording apparatus, the first tank may be placed above the second tank in the vertical direction in the apparatus-using state and the colorant concentration of the first ink may be less than the colorant concentration of the second ink.

In the ink jet recording apparatus, the first tank may be placed above the second tank in the vertical direction in the apparatus-using state, the first ink may be a dye ink, and the second ink may be a pigment ink.

In the ink jet recording apparatus, the first tank may be placed above the second tank in the vertical direction and the first ink may be a white ink or a clear ink.

In the ink jet recording apparatus, the first tank may be placed above the second tank in the vertical direction in the apparatus-using state and the second ink may be a blackish ink.

According to an aspect of the present disclosure, an ink jet recording set includes the ink jet recording apparatus and an ink supply container supplying the first ink to the first tank.

In the ink jet recording set, the ink supply container may be of a pneumatic type.

DESCRIPTION OF EXEMPLARY EMBODIMENTS

Embodiments of the present disclosure are described below. The embodiments below illustrate examples of the present disclosure. The present disclosure is not in any way limited to the embodiments and includes various modifications made without departing from the spirit of the present disclosure. Incidentally, all of components described below are not necessarily essential components of the present disclosure.

1. Ink Jet Recording Apparatus

An ink jet recording apparatus 1 according to an embodiment of the present disclosure includes a first tank storing a first ink and a second tank storing a second ink different from the first ink.

The outline of the ink jet recording apparatus 1 and ink are described below, followed by describing the arrangement of tanks and other features.

1.1. Outline of Ink Jet Recording Apparatus

Figure 1:
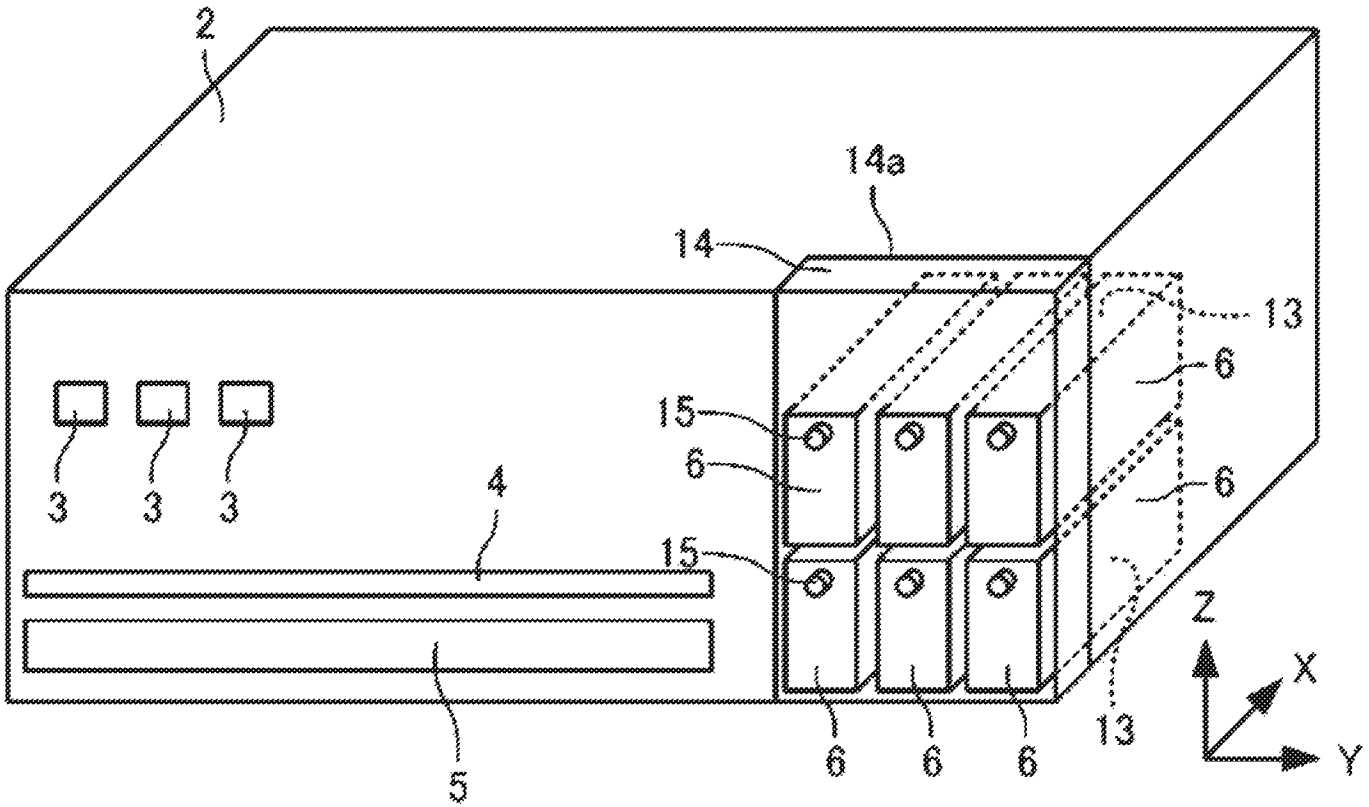
FIG. 1 is a schematic perspective view of an ink jet recording apparatus according to an embodiment of the present disclosure.
Figure 2:
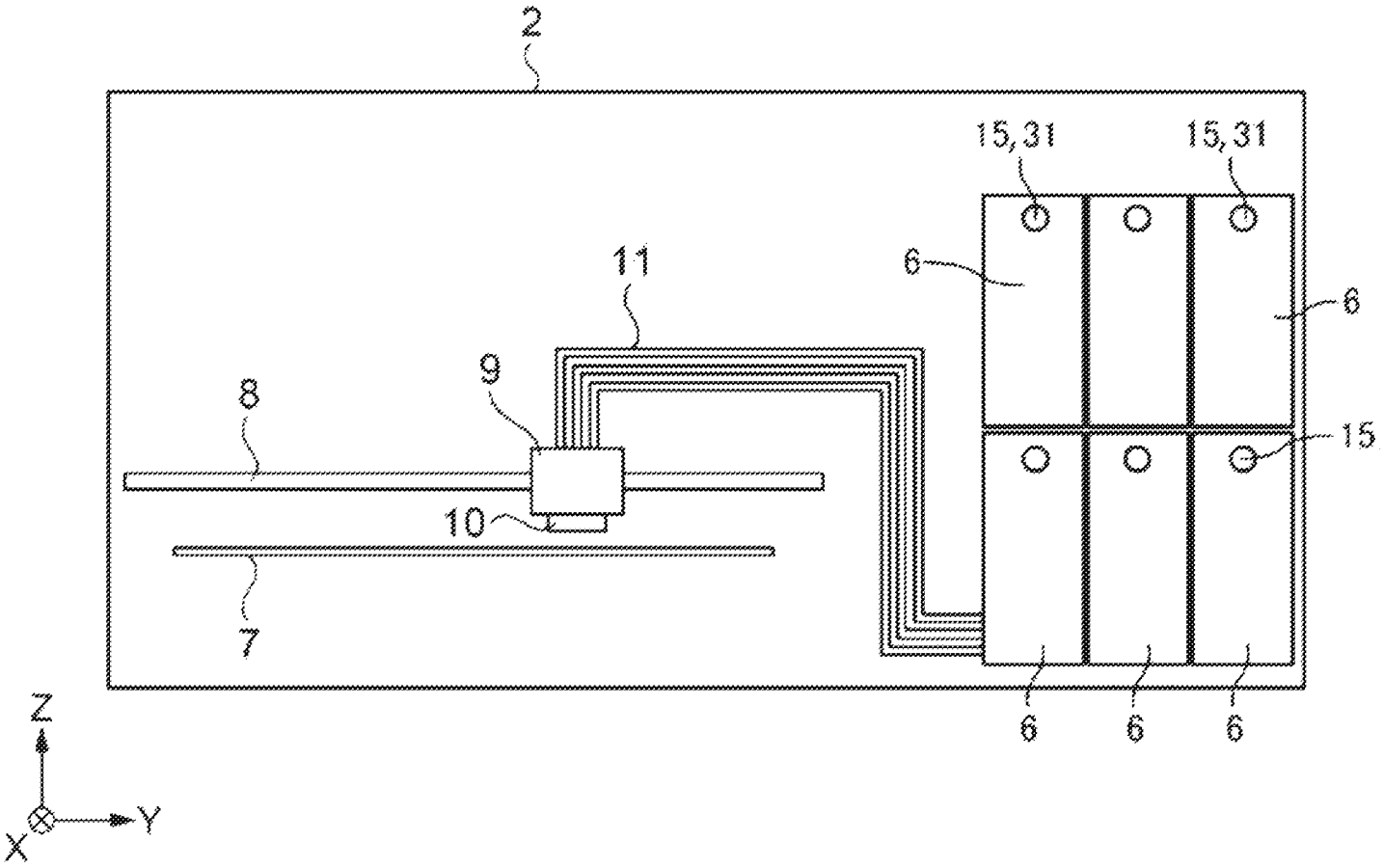
FIG. 2 is a schematic view illustrating the schematic internal structure of the ink jet recording apparatus shown in FIG. 1.
Figure 3:
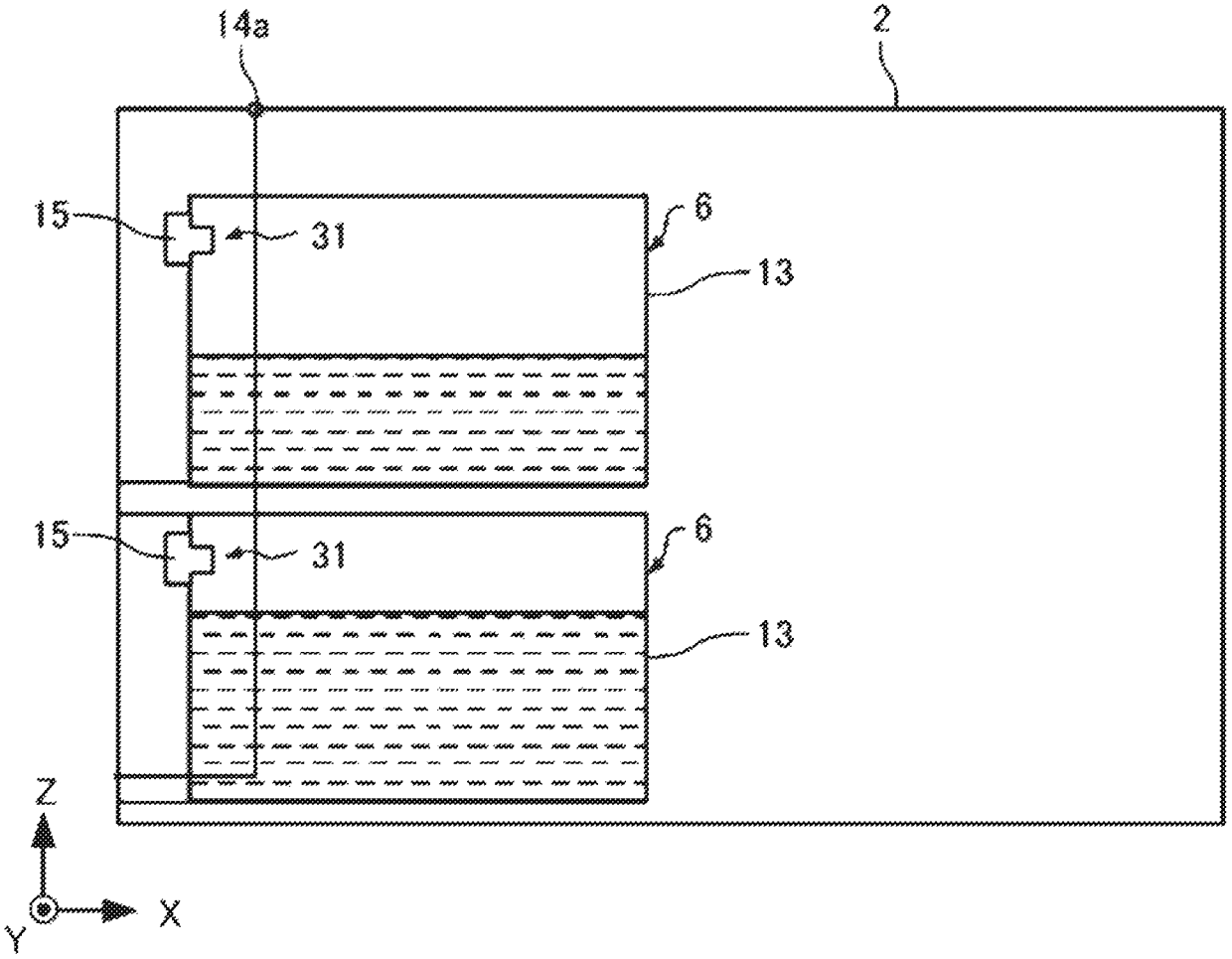
FIG. 3 is a schematic view illustrating the state of tanks in the ink jet recording apparatus shown in FIG. 1.

FIG. 1 is a schematic perspective view of the ink jet recording apparatus 1. FIG. 2 is a schematic sectional view of the ink jet recording apparatus 1 viewed from the front thereof (in a direction along a positive direction of an X-axis in FIG. 1) and is also a schematic view illustrating the schematic internal structure of the ink jet recording apparatus 1. FIG. 3 is a schematic view of the ink jet recording apparatus 1 viewed from a side surface (in a direction along a negative direction of a Y-axis in FIG. 1). Referring to FIG. 3, ink stored in each of tanks 6 (ink storage chambers 13) is hatched.

The outline of the ink jet recording apparatus 1 is described with reference to FIGS. 1 and 2. As shown in FIG. 1, the ink jet recording apparatus 1 includes a housing 2 with substantially a box shape.

In descriptions in this specification, a longitudinal direction (width direction) of the housing 2 is defined as a Y-direction, a lateral direction (depth direction) of the housing 2 is defined as an X-direction, and a height direction of the housing 2 is defined as a Z-direction. Furthermore, the tip side of an arrow indicating a direction is defined as a (+) direction and the tail side of an arrow indicating a direction is defined as a (−) direction.

On the front side (X(−) direction side) of the ink jet recording apparatus 1, a plurality of operation buttons 3, a recording medium cassette 5, a recording medium outlet 4, and the tanks 6, in which ink is stored. Each of inks of a plurality of colors is stored in a corresponding one of the tanks 6.

The recording medium cassette 5 is configured to be drawable on the front side and can contain a plurality of stacked recording media 7 (see FIG. 2). When a user operates the operation buttons 3 or a signal instructing recording is input from an external computer, which is not shown, the recording media 7 are supplied from the recording medium cassette 5 and images are recorded on the recording media 7 in the housing 2, followed by ejecting the recording media 7 from the recording medium outlet 4.

As shown in FIG. 2, a guide rail 8 extending in the Y-direction and a carriage 9, supported with the guide rail 8, reciprocating above the recording media 7 are placed in the housing 2. A recording head 10 provided with a plurality of nozzles (not shown) is mounted on the bottom side (Z(−) direction side) of the carriage 9. Inks are discharged from the nozzles of the recording head 10 toward the recording media 7.

The tanks 6 are communicatively connected to the recording head 10 with flexible ink tubes 11. The inks stored in the tanks 6 are supplied to the recording head 10 through the ink tubes 11.

As described above, the ink jet recording apparatus 1 includes the recording head 10, which discharges inks of a plurality of colors, and the tanks 6, which supply inks of a plurality of colors to the recording head 10.

The ink jet recording apparatus 1 further includes a recording mechanism allowing the recording head 10 to discharge inks in accordance with the reciprocation of the carriage 9 and the transport of the recording media 7 and records images on the recording media 7.

In examples shown in FIGS. 1 to 3, the number of the tanks 6 placed in the ink jet recording apparatus 1 is six. Each of the six tanks 6 stores a corresponding one of a yellow ink, a magenta ink, a cyan ink, a black ink, a light magenta ink, and a light cyan ink. As described above, the ink jet recording apparatus 1 includes the tanks 6, which supply inks of a plurality of colors to the recording head 10.

The housing 2 includes an upper lid 14. The upper lid 14 can swing about an X(+) direction side end 14*a*. Opening the upper lid 14 on the X(−) direction side using the X(+) direction side end 14*a* of the upper lid 14 as a fulcrum exposes cap members 15 of the ink storage chambers 13 in the tanks 6. When the amounts of the inks stored in the tanks 6 are small, a user opens the upper lid 14, removes the cap members 15, and can refill the ink storage chambers 13 with ink from ink inlets 31 (see FIG. 3).

1.2. Inks

The ink jet recording apparatus 1 discharges the inks stored in the tanks 6 from the nozzles of the recording head 10. The inks contain at least a solvent. The inks may be pigment inks containing a colorant, dye inks, or clear inks not intentionally containing any colorant.

1.2.1. Solvent

Ink used in the ink jet recording apparatus 1 contains a solvent. The solvent used may be a known one such as water, an organic solvent, or a polymerizable compound. The content of the solvent in the ink is preferably 45.0% by mass or more, more preferably 50.0% by mass to 98.0% by mass, and further more preferably 55.0% by mass to 95.0% by mass.

1.2.2. Colorant

The ink used in the ink jet recording apparatus 1 may contain a colorant. The colorant used may be either of pigment or dye or may be an inorganic pigment including carbon black, an organic pigment, an oil-soluble dye, an acidic dye, a direct dye, a reactive dye, a basic dye, a disperse dye, a sublimation dye, or the like. In the ink used in the ink jet recording apparatus 1, the colorant may be dispersed with a dispersible resin, a self-dispersible colorant may be used, the colorant may be dissolved, or these colorants may be used in combination.

The inorganic pigment used may be carbon black (C.I. Pigment Black 7) such as furnace black, lamp black, acetylene black, or channel black; iron oxide; titanium oxide; zinc oxide; silica; or the like.

Examples of the carbon black used include those, such as No. 2300, 900, MCF 88, No. 20B, No. 33, No. 40, No. 45, No. 52, MA 7, MA 8, MA 100, and No. 2200B, available from Mitsubishi Chemical Corporation; those, such as Color Black FW 1, Color Black FW 2, Color Black FW 2V, Color Black FW 18, Color Black FW 200, Color Black S 150, Color Black S 160, Color Black S 170, Printex 35, Printex U, Printex V, Printex 140U, Special Black 6, Special Black 5, Special Black 4A, Special Black 4, and Special Black 250, available from Degussa AG; those, such as Conductex SC, Raven 1255, Raven 5750, Raven 5250, Raven 5000, Raven 3500, Raven 1255, and Raven 700, available from Columbian Carbon Company; and those, such as Regal 400R, Regal 330R, Regal 660R, Mogul L, Monarch 700, Monarch 800, Monarch 880, Monarch 900, Monarch 1000, Monarch 1100, Monarch 1300, Monarch 1400, and Elftex 12, available from Cabot Corporation.

Examples of a white pigment include metal compounds such as metal oxides, barium sulfate, and calcium carbonate. Examples of the metal oxides include titanium oxide, zinc oxide, silica, alumina, and magnesium oxide. The white pigment used may be particles having a hollow structure. The particles having the hollow structure may be those known. Among those exemplified above, the white pigment used is preferably titanium dioxide from the viewpoint that the degree of whiteness is good. The white pigment may be used alone or in combination with one or more white pigments.

In this specification, the term "white" as used in a white ink, a white pigment, or the like refers to not only complete white but also a colored color such as a chromatic color or an achromatic color and a glossy color in a range where these colors can be visually recognized as white. More quantitatively, the term "white" includes not only a color in which L* is 100 but also a color in which L* is 80 to 100 and in which a* and b* are ±10 or less in, for example, CIELAB.

As the organic pigment, the following pigments can be exemplified: a quinacridone pigment, a quinacridonequinone pigment, a dioxazine pigment, a phthalocyanine pigment, an anthrapyrimidine pigment, an anthanthrone pigment, an indanthrone pigment, a flavanthrone pigment, a perylene pigment, a diketopyrrolopyrrole pigment, a perinone pigment, a quinophthalone pigment, an anthraquinone pigment, a thioindigo pigment, a benzimidazolone pigment, an isoindolinone pigment, an azomethine pigment, an azo pigment, and the like.

Examples of the organic pigment, which is used in ink, are those described below.

As a cyan pigment, C.I. Pigment Blues 1, 2, 3, 15:3, 15:4, 15:34, 16, 22, and 60 and C.I. Vat Blues 4 and 60 are cited and one or more selected from C.I. Pigment Blues 15:3, 15:4, and 60 can be preferably exemplified.

As a magenta pigment, C.I. Pigment Reds 5, 7, 12, 48(Ca), 48(Mn), 57(Ca), 57:1, 112, 122, 123, 168, 184, and 202 and C.I. Pigment Violet 19 are cited and one or more selected from C.I. Pigment Reds 122, 202, and 209 and C.I. Pigment Violet 19 can be preferably exemplified.

As a yellow pigment, C.I. Pigment Yellows 1, 2, 3, 12, 13, 14C, 16, 17, 73, 74, 75, 83, 93, 95, 97, 98, 119, 110, 114, 128, 129, 138, 150, 151, 154, 155, 180, and 185 and one or more selected from C.I. Pigment Yellows 74, 109, 110, 128, and 138 can be preferably exemplified.

As an orange pigment, C.I. Pigment Orange 36 or 43 or a mixture of C.I. Pigment Oranges 36 and 43 can be exemplified. As pigment for use in a green ink, C.I. Pigment Green 7 or 36 or a mixture of C.I. Pigment Greens 7 and 36 can be exemplified.

The above-exemplified pigments are examples of preferred pigment. The present disclosure is not limited by these pigments. These pigments may be used alone or in combination or may be used in combination with dye.

Pigment may be used in the form of a pigment dispersion using a dispersant selected from a water-soluble resin, a water-dispersible resin, and a surfactant or may be used in the form of a self-dispersible pigment obtained by oxidizing or sulfonating the pigment surface with ozone, hypochlorous acid, fuming sulfuric acid, or the like.

In a case where pigment is dispersed in the ink used in the ink jet recording apparatus 1 using a dispersible resin, the ratio of the pigment to the dispersible resin is preferably 10:1 to 1:10 and more preferably 4:1 to 1:3 on a mass basis. The maximum particle size and volume-average particle size of the dispersed pigment are preferably less than 500 nm and 300 nm or less, respectively, as measured by a dynamic light scattering method and the volume-average particle size thereof is more preferably 200 nm or less.

As dye usable in the ink used in the ink jet recording apparatus 1, water-soluble dyes such as acidic dyes, direct dyes, reactive dyes, and basic dyes; water-dispersible dyes such as disperse dyes; oil-soluble dyes; sublimation dyes; and the like can be cited.

As the acidic dyes, C.I. Acid Yellows 17, 23, 42, 44, 79, and 142; C.I. Acid Reds 52, 80, 82, 249, 254, and 289; C.I. Acid Blues 9, 45, and 249; C.I. Acid Blacks 1, 2, 24, and 94; and the like can be exemplified.

As the direct dyes, C.I. Direct Yellows 1, 12, 24, 33, 50, 55, 58, 86, 132, 142, 144, and 173; C.I. Direct Reds 1, 4, 9, 80, 81, 225, and 227; C.I. Direct Blues 1, 2, 15, 71, 86, 87, 98, 165, 199, and 202; C.I. Direct Blacks 19, 38, 51, 71, 154, 168, and 195; C.I. Direct Blues 2, 3, 8, 10, 12, 31, 35, 63, 116, 130, 149, 199, 230, and 231; and the like can be exemplified.

As the reactive dyes, C.I. Reactive Yellows 2, 7, 15, 22, 37, 42, 57, 69, 76, 81, 95, 102, 125, and 135; C.I. Reactive Reds 2, 14, 24, 32, 55, 79, 106, 111, and 124; C.I. Reactive Blues 2, 13, 21, 38, 41, 50, 69, 72, 109, 120, and 143; C.I. Reactive Blacks 3, 4, 5, 8, 13, 14, 31, 34, 35, and 39; and the like can be exemplified.

As the basic dyes, C.I. Basic Yellows 1, 2, 13, 19, 21, 25, 32, 36, 40, and 51; C.I. Basic Reds 1, 5, 12, 19, 22, 29, 37, 39, and 92; C.I. Basic Blues 1, 3, 9, 11, 16, 17, 24, 28, 41, 45, 54, 65, and 66; C.I. Basic Blacks 2 and 8; and the like can be exemplified.

The disperse dyes and the oil-soluble dyes may be any colorants which are not dissolved but are dispersed in an ink vehicle. As the disperse dyes and the oil-soluble dyes, azo dyes, metal-complex azo dyes, anthraquinone dyes, phthalocyanine dyes, and triarylmethane dyes can be exemplified.

As the disperse dyes, C.I. Disperse Reds 60, 82, 86, 86:1, 167:1, and 279; C.I. Disperse Yellows 64, 71, 86, 114, 153, 233, and 245; C.I. Disperse Blues 27, 60, 73, 77, 77:1, 87, 257, and 367; C.I. Disperse Violets 26, 33, 36, and 57; C.I. Disperse Oranges 30, 41, and 61; and the like can be exemplified.

As the oil-soluble dyes, C.I. Solvent Yellows 16, 21, 25, 29, 33, 51, 56, 82, 88, 89, 150, and 163; C.I. Solvent Reds 7, 8, 18, 24, 27, 49, 109, 122, 125, 127, 130, 132, 135, 218, 225, and 230; C.I. Solvent Blues 14, 25, 35, 38, 48, 67, 68, 70, and 132; C.I. Solvent Blacks 3, 5, 7, 27, 28, 29, and 34; and the like can be exemplified.

The sublimation dyes used may be disperse dyes having sublimation properties, oil-soluble dyes having sublimation properties, and the like. Examples of such dyes include C.I. Disperse Yellows 3, 7, 8, 23, 39, 51, 54, 60, 71, and 86; C.I. Disperse Oranges 1, 1:1, 5, 20, 25, 25:1, 33, 56, and 76; C.I. Disperse Brown 2; C.I. Disperse Reds 11, 50, 53, 55, 55:1, 59, 60, 65, 70, 75, 93, 146, 158, 190, 190:1, 207, 239, and 240; C.I. Vat Red 41; C.I. Disperse Violets 8, 17, 23, 27, 28, 29, 36, and 57; C.I. Disperse Blues 19, 26, 26:1, 35, 55, 56, 58, 64, 64:1, 72, 72:1, 81, 81:1, 91, 95, 108, 131, 141, 145, and 359; and C.I. Solvent Blues 36, 63, 105, and 111. These may be used alone or in combination.

The above-exemplified dyes are examples of preferred colorants. The present disclosure is not limited by these dyes. These dyes may be used alone or in combination or may be used in combination with pigment.

When the colorant is contained, the content thereof can be appropriately adjusted depending on applications, is preferably 0.10% by mass to 20.0% by mass, is more preferably 0.20% by mass to 15.0% by mass, and is further more preferably 1.0% by mass to 10.0% by mass.

1.2.3. Other Components

The ink used in the ink jet recording apparatus 1 may further contain, for example, additives such as dispersants, resin particles, pH adjustors, chelating agents, humectants, rust preventives, oxidation inhibitors, ultraviolet absorbers, oxygen absorbers, and dissolution aids, usually usable in ink jet inks as components other than the above.

1.3. Tanks

In the ink jet recording apparatus 1, the number of the tanks 6 is six. The number of the tanks 6 is not particularly limited and may be two or more. The number of the tanks 6 may be five or less or may be seven or more. In examples shown in FIGS. 1 to 3, the six tanks 6 are placed together on one end side of the ink jet recording apparatus 1. For example, two of the tanks 6 and four of the tanks 6 may be placed on one end side of the ink jet recording apparatus 1 and the other end side, respectively.

1.3.1. Shape and the Like of Tanks

Each of the tanks 6 includes a corresponding one of the ink storage chambers 13, which store ink. The tanks 6 can supply ink to the ink tubes 11. The shape of the tanks 6, material forming the tanks 6, or the like is not particularly limited. However, the tanks 6 preferably have substantially a cuboid profile because the tanks 6 are readily placed side by side or are readily stacked. A portion of each tank 6 that is in contact with ink is preferably made of a polyolefin material because the polyolefin material is unlikely to affect the composition or properties of the ink.

Each of the tanks 6 may have a corresponding one of the ink inlets 31, which can supply ink to the tanks 6. The ink inlets 31 are openings communicatively connecting the outside of the tanks 6 to the ink storage chambers 13 and therefore ink can be poured into the tanks 6 from the outside through the ink inlets 31.

Each of the ink inlets 31 may be placed in, for example, a side surface of a corresponding one of the tanks 6 in a state in which an apparatus is used as exemplified in the ink jet recording apparatus 1. Alternatively, each of the ink inlets 31 may be placed in the upper surface of a corresponding one of the tanks 6 in a state in which the apparatus is used. When each of the ink inlets 31 is placed in a side surface of a corresponding one of the tanks 6 in a state in which the apparatus is used, each of the ink inlets 31 is preferably located at a position closer to the upper surface of a corresponding one of the tanks 6 than the bottom surface thereof.

In this specification, the term "apparatus-using state" or "a state in which an apparatus is used" refers to a state in which the ink jet recording apparatus 1 is placed in a recording mode.

The ink inlets 31 may be simple openings as exemplified in the ink jet recording apparatus 1 or may have a structure fitted to a supply port of an ink supply container below. The ink inlets 31 may have a circular shape or another shape.

When the tanks 6 are provided with the ink inlets 31, the ink inlets 31 may have such a structure that an airflow path can be formed at the time of pouring ink. In a case where the ink supply container is connected to the ink inlets 31 and ink is poured into the tanks 6 from the ink supply container, when the ink supply container is of a pneumatic type, the ink can be readily poured in such a manner that air in the tanks 6 is released into the atmosphere. From this viewpoint, the ink inlets 31 or the supply port may be configured such that a structure in which an airflow path is formed so as to communicatively connect the inside of each tank 6 to the atmosphere is formed without sealing by fitting the supply port of the ink supply container when the ink supply container is connected to the ink inlets 31.

The tanks 6 may be provided with other components. The tanks 6 may be provided with, for example, irregularities guiding a position when the tanks 6 are stacked; such windows, scales, water-level tubes, or floats that can confirm the amount of ink in the ink storage chambers 13 of the tanks 6 from the outside; and the like.

1.3.2. Arrangement of Tanks and Names

In the ink jet recording apparatus 1, which includes the tanks 6, at least one of the tanks 6 is stacked on another one of the tanks 6. That is, in the ink jet recording apparatus 1, at least one of the tanks 6 is placed to have overlap when viewed in a vertical direction in an apparatus-using state.

Arranging the tanks 6 as described above enables the installation area or footprint of the ink jet recording apparatus 1 to be reduced. Furthermore, the height of the tanks 6 in the vertical direction can be reduced. Therefore, when ink is poured into the tanks 6, the height from which the poured ink falls is small and foaming can be suppressed at the time of pouring. That is, if tanks with reduced height (size in the Z-direction in the figures) are stacked, in a case where tanks with the same volume are mounted, the height of tanks can be reduced and foaming can be suppressed at the time of pouring ink as compared to a case where a plurality of tanks with reduced width (size in the Y-direction in the figures) are arranged in the Y-direction. Since the foaming of ink can be suppressed, failure in discharge from the recording head 10 can be suppressed and better discharge stability can be obtained.

In this specification, one of the tanks 6 is referred to as a "first tank", another one of the tanks 6 that is other than the first tank is referred to as a "second tank", and the first tank is placed above the second tank in the vertical direction.

In a case where the first tank and the second tank are selected, if the selected first and second tanks are arranged so as to have overlap when viewed in the vertical direction in the apparatus-using state, the installation area or footprint of the ink jet recording apparatus 1 can be reduced. In this case, the first and second tanks can be conveniently selected from the tanks 6 such that such arrangement is obtained. In this specification, ink stored in the first tank is referred to as a "first ink" and ink stored in the second tank is referred to as a "second ink".

As a mode in which two tanks are arranged so as to have overlap when viewed in the vertical direction in the apparatus-using state, a mode in which tanks are stacked in two layers and a mode in which tanks are stacked in three or more layers are cited. Two tanks may be wholly stacked when viewed in the vertical direction in the apparatus-using state. In a case where tanks are stacked in three or more layers, the height of the tanks in the vertical direction can be further reduced. Therefore, when ink is poured into the tanks, the height from which the poured ink falls is small. This enhances the effect of suppressing foaming at the time of pouring.

The ink jet recording apparatus 1 may include six or more tanks storing inks different from each other. In this case, the first tank may be one of the six or more tanks and the second tank may be another one of the six or more tanks that is other than the first tank.

When the number of the tanks is six or more, stacking the tanks allows the effect of reducing the installation area to be remarkable.

1.3.3. Variation in Arrangement of Tanks

FIGS. 4 to 8 are schematic views illustrating examples of the arrangement of the tanks 6. FIGS. 4 to 8 are schematic views in which the tanks 6 are viewed from the front side (the front viewed from the X− side in an X+ direction) of the ink jet recording apparatus 1, which is shown in FIGS. 1 to 3.

Figure 4:
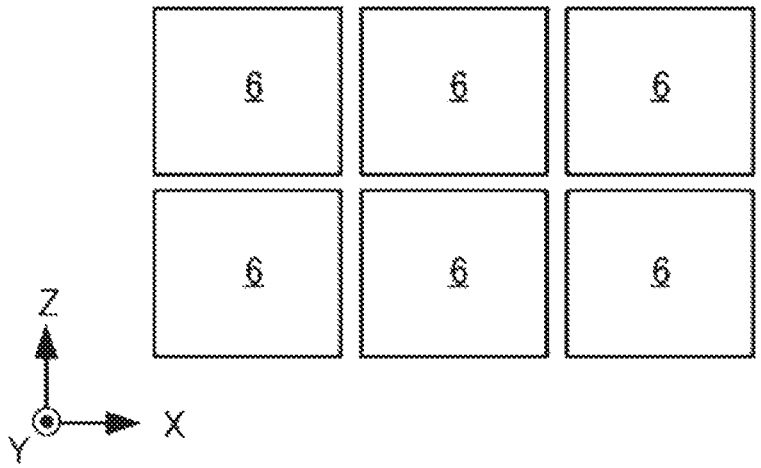
FIG. 4 is a schematic view illustrating an example of the arrangement of tanks according to an embodiment.

In an example shown in FIG. 4, six of the tanks 6 are stacked in two layers in the Z-direction such that three of the six tanks 6 are arranged in the X-direction. The example shown in FIG. 4 illustrates the outline of the arrangement of the tanks 6 in the ink jet recording apparatus 1, which is shown in FIGS. 1 and 2. In this example, setting one of the tanks 6 that is placed in the upper layer to the first tank and setting one of the tanks 6 that is placed thereunder to the second tank result in that the first tank and the second tank are arranged so as to have overlap when viewed in the vertical direction in the apparatus-using state.

Figure 12:
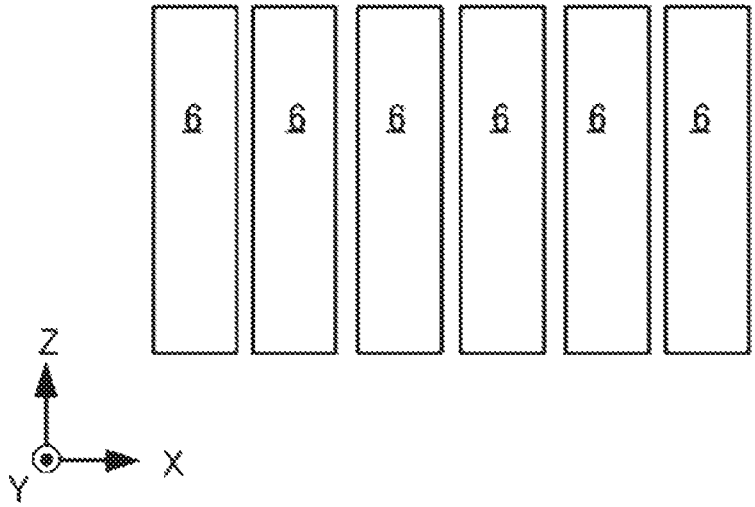
FIG. 12 is a schematic view illustrating an example of the arrangement of known ink inlets.

When the number of tanks, which are not shown, is two or more, it will be understood that stacking the tanks in two or more layers enables the installation area to be reduced and the drop distance of ink at the time of pouring the ink to be reduced as compared to a case where the tanks are thinned in the X-direction. That is, in a case where six tanks are arranged in the same installation area, stacking the six tanks in two layers in the Z-direction such that three of the six tanks are arranged in the X-direction as shown in FIG. 4 enables the drop distance of ink at the time of pouring the ink to be reduced as compared to a case where the width of the six tanks in the X-direction is reduced and the six tanks are arranged in a single layer in the X-direction (see FIG. 12).

Figure 5:
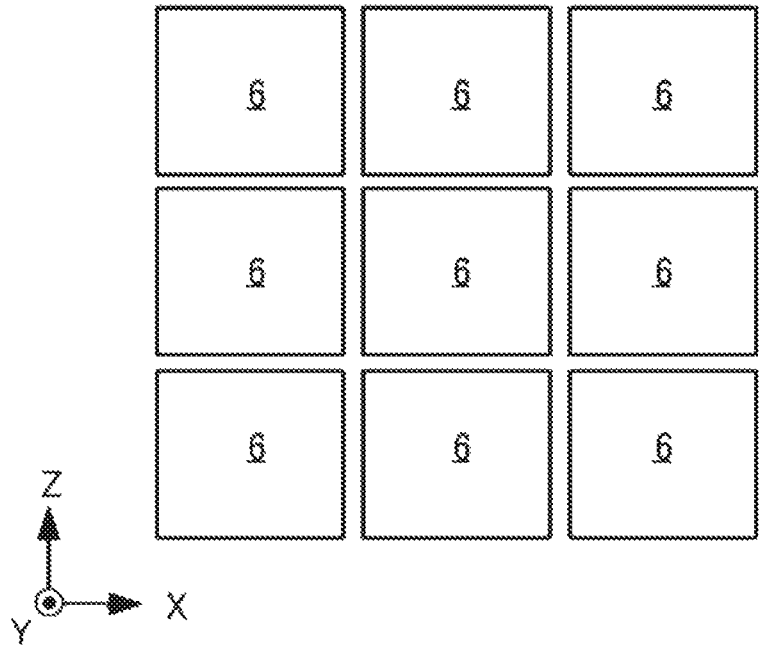
FIG. 5 is a schematic view illustrating an example of the arrangement of tanks according to an embodiment.

In an example shown in FIG. 5, nine of the tanks 6 are stacked in three layers in the Z-direction such that three of the nine tanks 6 are arranged in the X-direction. In the example shown in FIG. 5, setting one of the tanks 6 that is placed in the middle layer to the first tank and selecting one of the tanks 6 that is placed thereunder as the second tank result in that the first tank and the second tank are arranged so as to have overlap when viewed in the vertical direction in the apparatus-using state.

Figure 6:
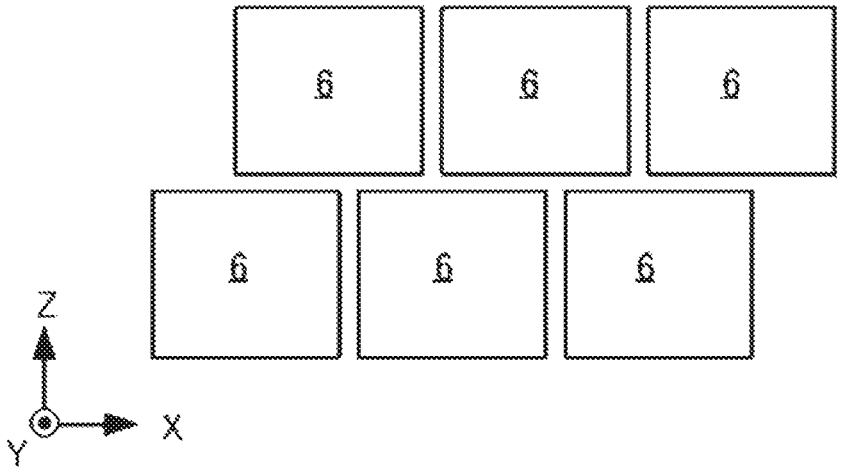
FIG. 6 is a schematic view illustrating an example of the arrangement of tanks according to an embodiment.

In an example shown in FIG. 6, six of the tanks 6 are stacked in two layers in the Z-direction such that three of the six tanks 6 are arranged in the X-direction and the upper layer and the lower layer are misaligned in the X-direction. In the example shown in FIG. 6, setting one of the tanks 6 that is placed in the upper layer to the first tank and selecting one of the tanks 6 that is placed thereunder as the second tank result in that the first tank and the second tank are arranged so as to have overlap when viewed in the vertical direction in the apparatus-using state.

Figure 7:
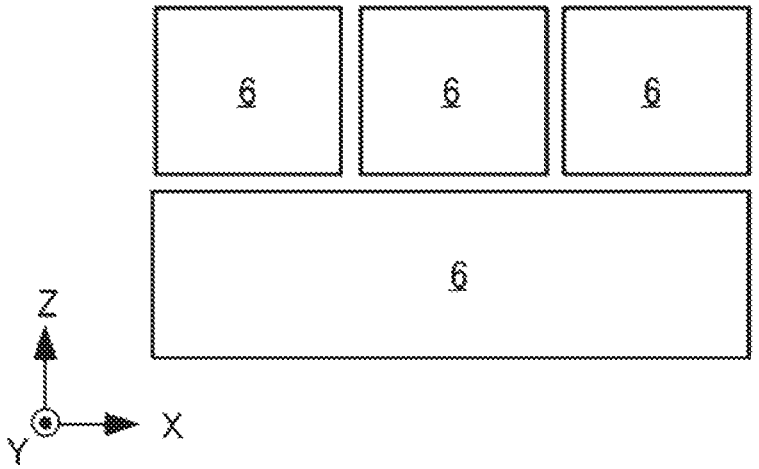
FIG. 7 is a schematic view illustrating an example of the arrangement of tanks according to an embodiment.

In an example shown in FIG. 7, four of the tanks 6 are stacked in two layers in the Z-direction such that one of the six tanks 6 is placed in the lower layer and three of the tanks 6 are arranged in the upper layer in the X-direction. In the example shown in FIG. 7, setting one of the tanks 6 that is placed in the upper layer to the first tank and selecting one of the tanks 6 that is placed in the lower layer as the second tank result in that the first tank and the second tank are arranged so as to have overlap when viewed in the vertical direction in the apparatus-using state.

Figure 8:
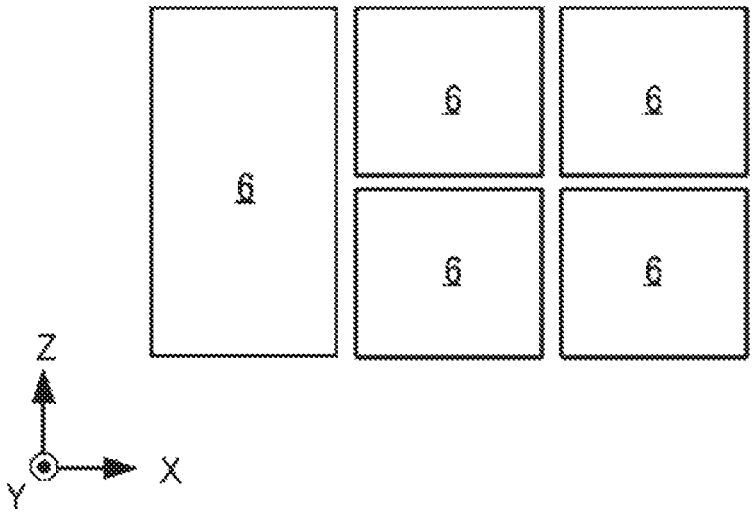
FIG. 8 is a schematic view illustrating an example of the arrangement of tanks according to an embodiment.

In an example shown in FIG. 8, five of the tanks 6 are arranged and four of the five tanks 6 are stacked in two layers in the Z-direction such that two of the tanks 6 are arranged in the X-direction. The remaining one of the tanks 6 is placed without being stacked in the Z-direction. In the example shown in FIG. 8, setting one of the four tanks 6 that is placed in the upper layer to the first tank and selecting one of the tanks 6 that is placed in the lower layer as the second tank result in that the first tank and the second tank are arranged so as to have overlap when viewed in the vertical direction in the apparatus-using state.

If the selected first and the second tanks are arranged so as to have overlap when viewed in the vertical direction in the apparatus-using state as exemplified in FIGS. 4 to 8, the installation area or footprint of the ink jet recording apparatus 1 can be reduced and foaming can be suppressed at the time of pouring ink.

1.3.4. Variation in Arrangement of Ink Inlets

It has been already described that each of the first tank and the second tank may be provided with a corresponding one of the ink inlets 31. The ink inlet 31 of the first tank and the ink inlet 31 of the second tank are preferably arranged so as not to have overlap when viewed in the vertical direction in the apparatus-using state.

When ink is poured into the tanks 6 from the ink inlets 31, the ink may possibly spill or spread. In this case, when the ink inlet 31 of the first tank (one of the stacked tanks 6 that is located on the upper side) and the ink inlet 31 of the second tank (one of the stacked tanks 6 that is located on the lower side) have overlap when viewed in the vertical direction in the apparatus-using state, the first ink spilling from the ink inlet 31 of the first tank is likely to adhere to the ink inlet 31 of the second tank or is likely to enter the second tank. When the ink inlet 31 of the first tank and the ink inlet 31 of the second tank are arranged so as not to have overlap when viewed in the vertical direction in the apparatus-using state, the contamination of the second ink in the second tank with the first ink in the first tank can be suppressed.

Figure 9:
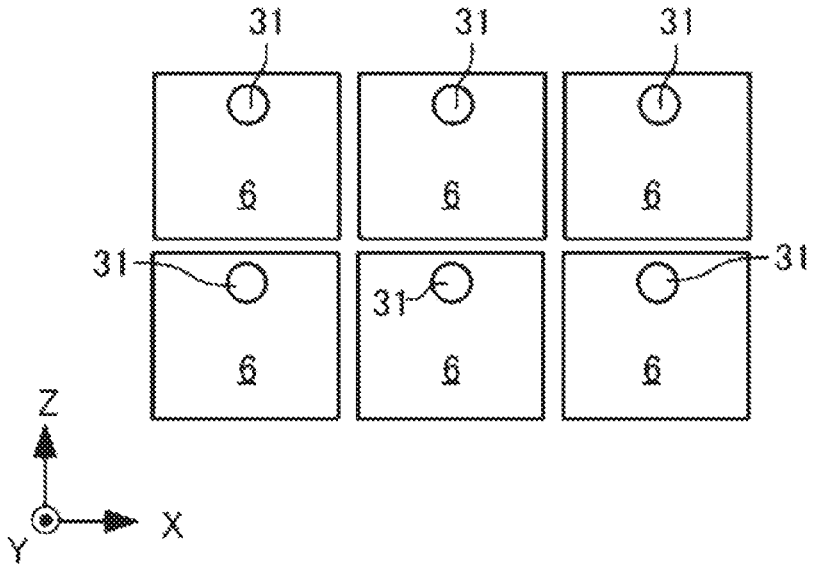
FIG. 9 is a schematic view illustrating an example of the arrangement of ink inlets according to an embodiment.
Figure 10:
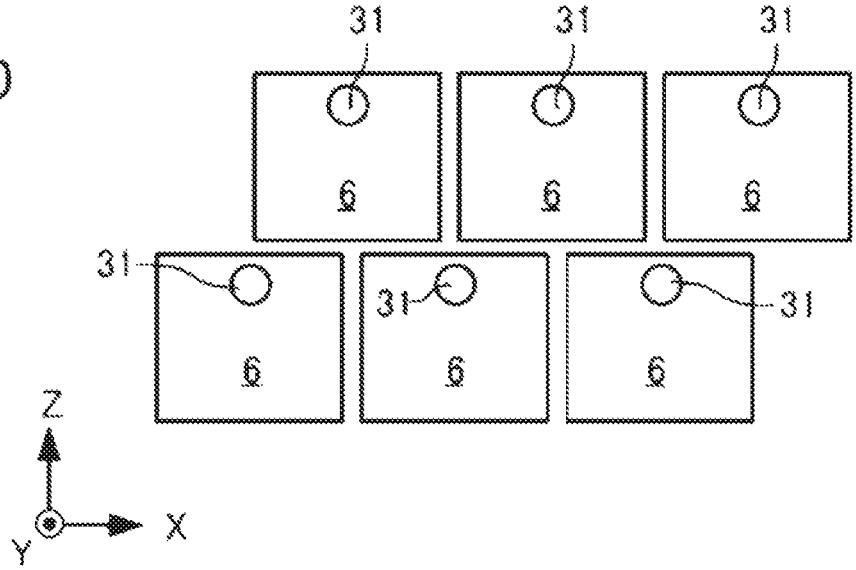
FIG. 10 is a schematic view illustrating an example of the arrangement of ink inlets according to an embodiment.
Figure 11:
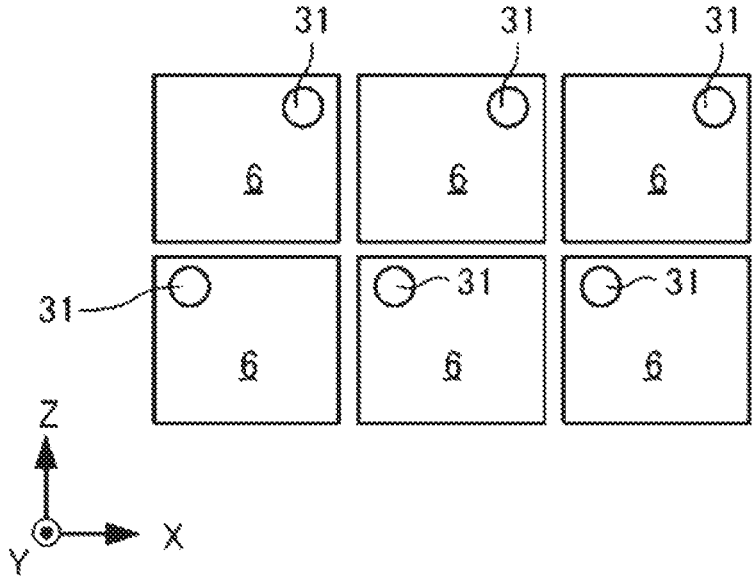
FIG. 11 is a schematic view illustrating an example of the arrangement of ink inlets according to an embodiment.

FIGS. 9 to 11 are schematic views illustrating examples of the arrangement of the ink inlets 31. FIGS. 9 to 11 are schematic views in which the tanks 6 and the ink inlets 31 are viewed from the front side (the front viewed from the X− side in the X+ direction) of the ink jet recording apparatus 1, which is shown in FIGS. 1 to 3.

In an example shown in FIG. 9, six of the tanks 6 are stacked in two layers in the Z-direction such that three of the six tanks 6 are arranged in the X-direction. The example shown in FIG. 9 illustrates the outline of the arrangement of the tanks 6 in the ink jet recording apparatus 1, which is shown in FIGS. 1 and 2. In this example, setting one of the tanks 6 that is placed in the upper layer to the first tank and setting one of the tanks 6 that is placed thereunder to the second tank result in that the first tank and the second tank are arranged so as to have overlap when viewed in the vertical direction in the apparatus-using state. However, the ink inlet 31 of the first tank and the ink inlet 31 of the second tank are arranged so as to have overlap when viewed in the vertical direction in the apparatus-using state.

In contrast to this, in an example shown in FIG. 10, six of the tanks 6 are stacked in two layers in the Z-direction such that three of the six tanks 6 are arranged in the X-direction and the upper layer and the lower layer are misaligned in the X-direction. In the example shown in FIG. 10, setting one of the tanks 6 that is placed in the upper layer to the first tank and selecting one of the tanks 6 that is placed thereunder as the second tank result in that the first tank and the second tank are arranged so as to have overlap when viewed in the vertical direction in the apparatus-using state. In addition, in the example shown in FIG. 10, the upper layer and the lower layer are misaligned in the X-direction and, as a result, the ink inlet 31 of the first tank and the ink inlet 31 of the second tank have no overlap when viewed in the vertical direction in the apparatus-using state. This enables the effect of suppressing the contamination of the second ink in the second tank with the first ink in the first tank to be further obtained.

In an example shown in FIG. 11, six of the tanks 6 are stacked in two layers in the Z-direction such that three of the six tanks 6 are arranged in the X-direction. However, the ink inlets 31 of the tanks 6 in the upper layer are arranged on the X+ direction side and the ink inlets 31 of the tanks 6 in the lower layer are arranged on the X-direction side. In the example shown in FIG. 11, setting one of the tanks 6 that is placed in the upper layer to the first tank and selecting one of the tanks 6 that is placed thereunder as the second tank result in that the first tank and the second tank are arranged so as to have overlap when viewed in the vertical direction in the apparatus-using state. In addition, in the example shown in FIG. 11, the ink inlet 31 of the first tank and the ink inlet 31 of the second tank have no overlap when viewed in the vertical direction in the apparatus-using state. This enables the effect of suppressing the contamination of the second ink in the second tank with the first ink in the first tank to be further obtained.

1.4. Variation in Arrangement of Inks

In this embodiment, the L* value of the first ink in CIELAB may be greater than the L* value of the second ink. That is, the first tank is placed above the second tank in the vertical direction in the apparatus-using state and the L* value of the first ink, which is stored in the first tank, may be greater than the L* value of the second ink, which is stored in the second tank. This can make the L* value of the second ink unlikely to vary significantly even if the first ink leaks and mixes with the second ink when the first ink is poured into the first tank.

In this embodiment, the colorant concentration of the first ink may be less than the colorant concentration of the second ink. This can make the color optical density of the second ink unlikely to vary significantly even if the first ink leaks and mixes with the second ink when the first ink is poured into the first tank. In particular, when the first ink and the second ink are different density inks of the same color, a remarkable effect can be obtained. Examples of a combination of the different density inks of the same color include a combination of cyan and light cyan inks, a combination of magenta and light magenta inks, a combination of black and gray inks, and a combination of gray and light gray inks.

Furthermore, in this embodiment, the first ink and the second ink may be a dye ink and a pigment dye, respectively. This can make the dispersion stability of the second ink unlikely to be significantly impaired even if the first ink leaks and mixes with the second ink when the first ink is poured into the first tank.

Furthermore, in this embodiment, the first ink may be a white ink or a clear ink. This can make the hue or color optical density of the second ink unlikely to vary significantly even if the first ink leaks and mixes with the second ink when the first ink is poured into the first tank. The term "white ink" refers to ink containing a white pigment among the above-mentioned inks. The term "clear ink" refers to ink containing no colorant or ink in which any colorant is not intentionally blended.

Furthermore, in this embodiment, the second ink may be a blackish ink. This can make the hue or color optical density of the second ink unlikely to vary significantly even if the first ink leaks and mixes with the second ink when the first ink is poured into the first tank. The term "blackish ink" refers to ink containing a black pigment or a black dye and includes a black ink, a light black ink, a gray ink, and the like.

2. Ink Jet Recording Set

An ink jet recording set according to an embodiment of the present disclosure includes the ink jet recording apparatus 1 and the ink supply container. The ink supply container supplies the first ink to the first tank. The ink jet recording set may include a plurality of ink supply containers capable of supplying inks to tanks.

2.1. Ink Supply Container

The ink supply container, which is included in the ink jet recording set, may be of a type in which ink stored in the ink supply container is poured into a tank by allowing the ink to fall under its own weight, that is, an own weight type or a type in which ink stored in the ink supply container is poured into a tank by increasing the pressure in the ink supply container, that is, a pneumatic type. As a pneumatic type ink supply container, an injector shape, a pack shape, and the like are cited.

A supply port of the ink supply container is arbitrary, may be capable of transferring ink to a tank, and may be provided with a pawl, an airflow groove, a packing, a thread, or the like. When the ink supply container is of the pneumatic type, ink can be smoothly supplied in such a manner that an airflow path is formed by an airflow groove in the supply port of the ink supply container or the like at the time of pouring the ink.

2.2. Effects

The ink jet recording set supplies ink to a tank of the ink jet recording apparatus 1 from the ink supply container. Therefore, foaming is suppressed at the time of pouring ink and recording can be stably performed with good discharge stability. When the ink supply container is of the pneumatic type, although the ease or promptness of pouring ink is increased, foaming is more likely to occur in some cases. In the tank of the ink jet recording apparatus 1, such foaming can be suppressed and the effect of stably performing recording is clearly exhibited.

The present disclosure is not limited to the above-mentioned embodiments and various modifications can be made. The present disclosure includes, for example, configurations substantially the same as the configurations described in the embodiments (for example, configurations having substantially the same function, method, and result or configurations having substantially the same purpose and effect). The present disclosure includes configurations obtained by replacing non-essential portions of the configurations described in the embodiments. The present disclosure includes configurations capable of providing the same effects as those of the configurations described in the embodiments or capable of achieving the same objects as those of the configurations described in the embodiments. Furthermore, the present disclosure includes configurations obtained by adding known techniques to the configurations described in the embodiments.

What is claimed is:

1. An ink jet recording apparatus comprising:

a first tank storing a first ink; and a second tank storing a second ink different from the first ink, wherein the first tank and the second tank are arranged so as to have overlap when viewed in a vertical direction in an apparatus-using state, each of the first tank and the second tank include an upper major surface, a lower major surface, and a plurality of side surfaces that connect the upper major surface to the lower major surface, each of the first and second tanks include an ink inlet formed on one of the plurality of side surfaces, and the inlet of the first tank and the ink inlet of the second tank do not overlap when viewed in the vertical direction in the apparatus-using state.

2. The ink jet recording apparatus according to claim 1, wherein the ink inlet forms an airflow path at the time of pouring ink.

3. The ink jet recording apparatus according to claim 1, further comprising six or more tanks storing inks different from each other, wherein the first tank is one of the six or more tanks and the second tank is one of the six or more tanks that is other than the first tank.

4. The ink jet recording apparatus according to claim 1, wherein the first tank is placed above the second tank in the vertical direction in the apparatus-using state and the L* value of the first ink is greater than the L* value of the second ink.

5. The ink jet recording apparatus according to claim 1, wherein the first tank is placed above the second tank in the vertical direction in the apparatus-using state and the colorant concentration of the first ink is less than the colorant concentration of the second ink.

6. The ink jet recording apparatus according to claim 1, wherein the first tank is placed above the second tank in the vertical direction in the apparatus-using state, the first ink is a dye ink, and the second ink is a pigment ink.

7. The ink jet recording apparatus according to claim 1, wherein the first tank is placed above the second tank in the vertical direction and the first ink is a white ink or a clear ink.

8. The ink jet recording apparatus according to claim 1, wherein the first tank is placed above the second tank in the vertical direction in the apparatus-using state and the second ink is a blackish ink.

* * * * *